US010850316B2

(12) United States Patent
Hu et al.

(10) Patent No.: US 10,850,316 B2
(45) Date of Patent: Dec. 1, 2020

(54) ROLLER ASSEMBLY

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Zhi-Yu Hu, Shenzhen (CN); Ting-Hui Deng, Shenzhen (CN); Chun-Xu Jin, Shenzhen (CN); Jin-Hua Ye, Shenzhen (CN); Long-Fong Chen, New Taipei (TW)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 251 days.

(21) Appl. No.: 16/034,757

(22) Filed: Jul. 13, 2018

(65) Prior Publication Data

US 2019/0344317 A1 Nov. 14, 2019

(30) Foreign Application Priority Data

May 11, 2018 (CN) ..... 2018 1 0448657

(51) Int. Cl.
*B21B 31/02* (2006.01)
*B21D 19/04* (2006.01)

(52) U.S. Cl.
CPC ..... *B21B 31/02* (2013.01); *B21D 19/04* (2013.01); *B21B 2205/00* (2013.01)

(58) Field of Classification Search
CPC ..... B21D 5/14; B21D 19/04; B21D 19/043; B21D 19/06; B21D 37/04; B21D 37/12; B21B 31/00; B21B 31/02; B21B 31/22; B21B 31/28; B21B 35/06; Y10T 29/53787; Y10T 29/53791
See application file for complete search history.

(56) References Cited

U.S. PATENT DOCUMENTS 3,855,834 A * 12/1974 Evans ..... B21D 19/04 72/179
4,117,704 A * 10/1978 Nakache ..... B21D 19/046 72/83
6,161,410 A * 12/2000 Shook ..... B21D 39/021 72/220
2002/0094233 A1* 7/2002 Price ..... B21D 19/04 403/338
2008/0236236 A1* 10/2008 Toeniskoetter ..... B21D 39/023 72/220
2010/0154503 A1* 6/2010 Hasegawa ..... B21D 39/023 72/199

* cited by examiner

*Primary Examiner* — Edward T Tolan
(74) *Attorney, Agent, or Firm* — ScienBiziP, P.C.

(57) ABSTRACT

A roller assembly includes a workbench, a roller module located above the workbench, and a locking assembly coupled to the roller module and configured to position the roller module above the workbench. The roller module includes a driving device and a pressure roller. The driving device is coupled to the pressure roller through a crank assembly. The crank assembly drives the pressure roller to move along a track to roll on a work-piece positioned on the workbench.

10 Claims, 4 Drawing Sheets

ROLLER ASSEMBLY

FIELD

The subject matter herein generally relates to roller assemblies for processing a work-piece.

BACKGROUND

Generally, a roller assembly is used for rolling on work-pieces to process the work-pieces for assembly.

BRIEF DESCRIPTION OF THE DRAWINGS

Implementations of the present disclosure will now be described, by way of example only, with reference to the attached figures.

DETAILED DESCRIPTION

Figure 1:
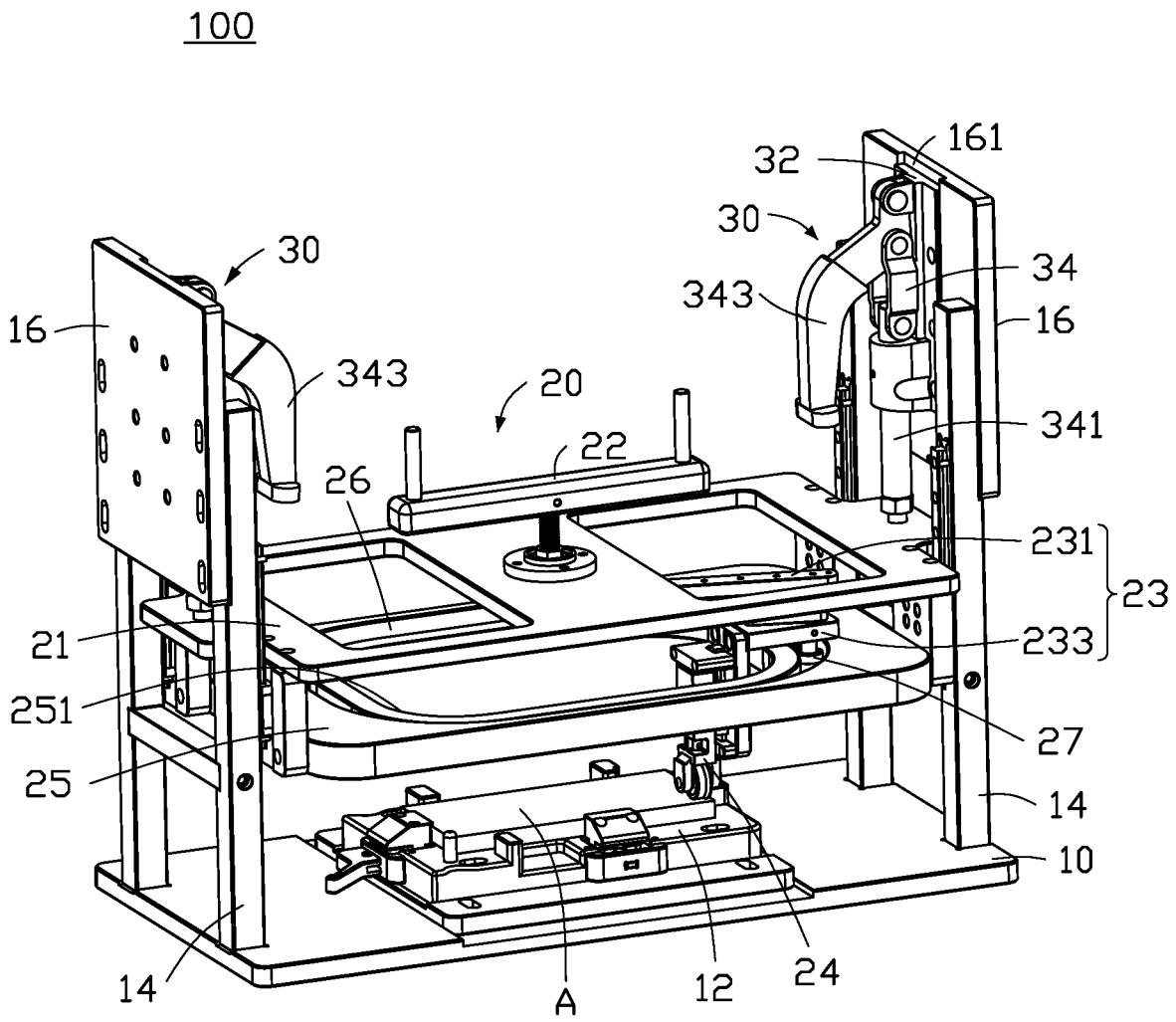
FIG. 1 is an assembled, isometric view of an embodiment of a roller assembly in accordance with an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

FIG. 1 illustrates an embodiment of a roller assembly 100. The roller assembly 100 includes a workbench 10, a roller module 20, and a locking assembly 30. The roller module 20 is located above the workbench 10 and is coupled to the locking assembly 30. The locking assembly 30 fixes the roller module 20 in position above the workbench 10. The roller module 20 includes a driving device 22 and a pressure roller 24. The driving device 22 is coupled to the pressure roller 24 through a crank assembly 23. The crank assembly 23 drives the pressure roller 24 to move along a track 26 to pressure roll a work-piece A on the workbench 10. In at least one embodiment, the workbench 10 includes a platform 12 and a pair of support frames 14. The platform 12 fixes the work-piece A in place. The support frames 14 are erected on opposite sides of the platform 12. A top of each of the support frames 14 includes a sliding board 16. The locking assembly 30 is located on the sliding boards 16. Thus, the locking assembly 30 is movable with the sliding boards 16 to adjust a position of the roller module 20. In detail, the sliding board 16 defines a sliding groove 161. The sliding groove 161 receives a sliding seat 32 therein. The sliding seat 32 includes a linking assembly 34. The linking assembly 34 includes a fixing bar 341 and a handle 343. The fixing bar 341 is coupled to the roller module 20. The handle 343 drives the fixing rod 341 to move the roller module 20 along the support frames 14 and locks the roller module 20 in position. As shown in FIG. 1, the roller module 20 is fixed in position by the locking assembly 30. In other words, a rolling position of the roller module 20 is fixed by pressing down the handles 343 to fix a position of the pressure roller 24. The pressure roller 24 pressure contacts the work-piece A. The driving device 22 of the roller module 20 drives the pressure roller 24 to pressure roll on the work-piece A. When the pressure roller 24 is finished pressure rolling on the work-piece A, the handles 343 are lifted up to release the locking assembly 30. When the handles 343 are lifted up, the handles 343, through the linking assembly 34, move the fixing rod 341 upward, and the roller module 20 coupled to the fixing rod 341 moves upward along with the fixing rod 341. Therefore, the handles 343 directly lock and release a position of the roller module 20 and the pressure roller 24. Of course, the locking assembly 30 can adjust the position of the roller module 20 and the pressure roller 24 by moving the sliding seat 32 on the sliding board 16 according to a height of the work-piece A on the platform 12.

The roller module 20 further includes a first guide board 21 and a second guide board 25. The first guide board 21 and the second guide board 25 are spaced apart and face each other. The first guide board 21 is located above the second guide board 25. The driving device 22 is located on the first guide board 21. The crank assembly 23 is located between the first guide board 21 and the second guide board 25. The crank assembly 23 is coupled to the pressure roller 24. The pressure roller 24 faces the work-piece A on the workbench 10. A top of the second guide board 25 defines the track 26. In at least one embodiment, the driving device 22 is a rotary handle (not shown) located on a top of the first guide board 21. The driving device 22 is rotationally coupled to the crank assembly 23. The rotary handle rotationally drives the crank assembly 23 to move. The crank assembly 23 includes a first crank 231 and a second crank 233. A first end of the first crank 231 is coupled to the driving device 22. A second end of the first crank 231 is slidably coupled to a first end of the second crank 233. A joint between the first crank 231 and the second crank 233 is adjacent to the track 26 defined in the top surface of the second guide board 25. A second end of the second crank 233 is coupled to the pressure roller 24. In addition, the joint between the first crank 231 and the second crank 233 includes two bearings 27 facing the top surface of the second guide board 25. The two bearings 27 are received within the track 26 of the second guide board 25. The bearings 27 are limited to move within the track 26 to control a rolling path of pressure roller 24 on the workbench 10.

Figure 2:
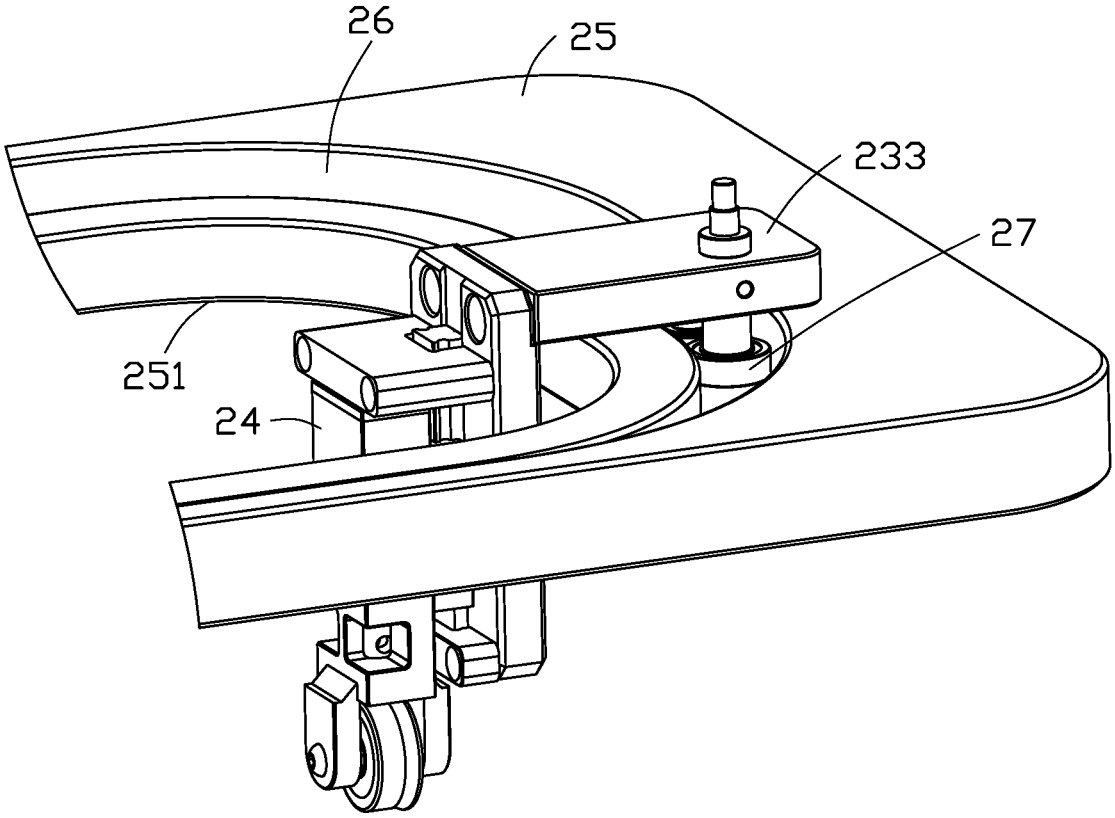
FIG. 2 is a partial isometric view of a track of a roller module of the roller assembly in FIG. 1.

Referring to FIG. 2, the track 26 controls a rolling path of the pressure roller 24 according to requirements of the work-piece A. In at least one embodiment, the work-piece A (as shown in FIG. 1) is a metal housing of a mobile phone. The track 26 is defined according to a requirement of pressure rolling a shape of the metal housing. The track 26 is defined around the top surface of the second guide board 25. The track 26 surrounds a space 251 defined in the second guide board 25. The space 251 is hollow and opens toward the workbench 10 (as shown in FIG. 1). The pressure roller 24 coupled to the second crank 233 is located within the space 251 and is limited by the track 26 to move within the space 251. In detail, the joint between the second crank 233 and the first crank 231 is pivotably formed. The two bearings 27 are received within the track 26. The second crank 233 is moved by the first crank 231 and is pivotably controlled to move along the track 26.

Figure 3:
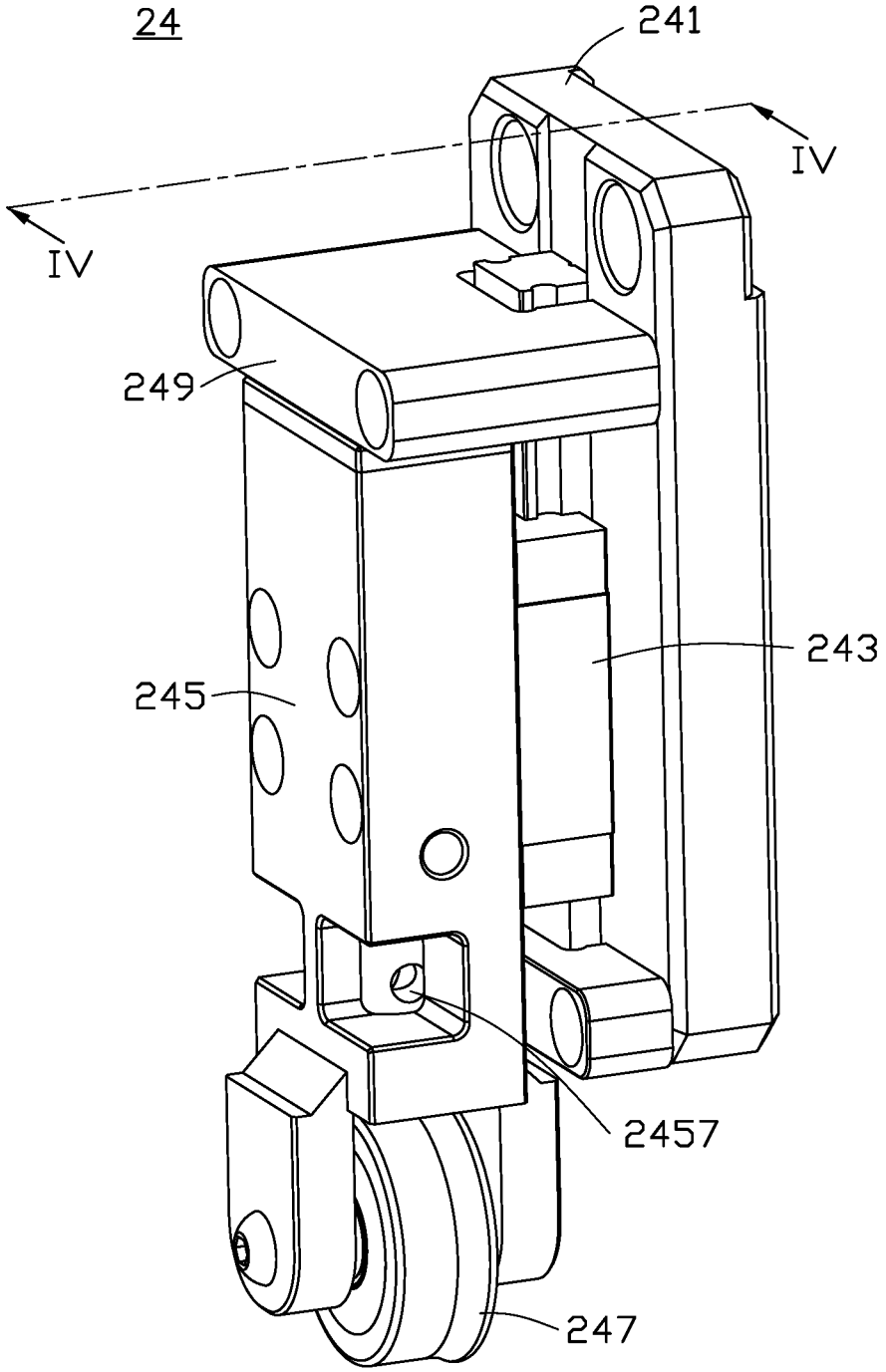
FIG. 3 is an isometric view of a pressure roller of the roller assembly in FIG. 1.

Referring to FIG. 3, the pressure roller 24 includes a mounting seat 241, a clamping block 243, a pressure rod 245, and a roller wheel 247. The mounting seat 241 is coupled to the second crank 233, and the clamping block 243 is located on the mounting seat 241. The clamping block 243 clamps the pressure rod 245. A top of the pressure rod 245 includes a stopping block 249. The stopping block 249 limits upward movement of the pressure rod 245. The roller wheel 247 is located at a bottom of the pressure rod 245. Because of the stopping block 249 limiting upward movement of the pressure rod 245, the roller wheel 247 applies pressure toward the workbench 10. In at least one embodiment, the mounting seat 241 coupled to the second crank 233 is erected vertically. The pressure rod 245 clamped by the clamping block 243 is also erected vertically. Thus, the roller wheel 247 faces toward the workbench 10. The stopping block 249 located on top of the pressure rod 245 limits upward movement of the pressure rod 245. An upper limit of the pressure rod 245 is an operating position of the pressure roller 24 of the roller module 20 (as shown in FIG. 1) to enable the pressure roller 24 to pressure contact the work-piece A.

Figure 4:
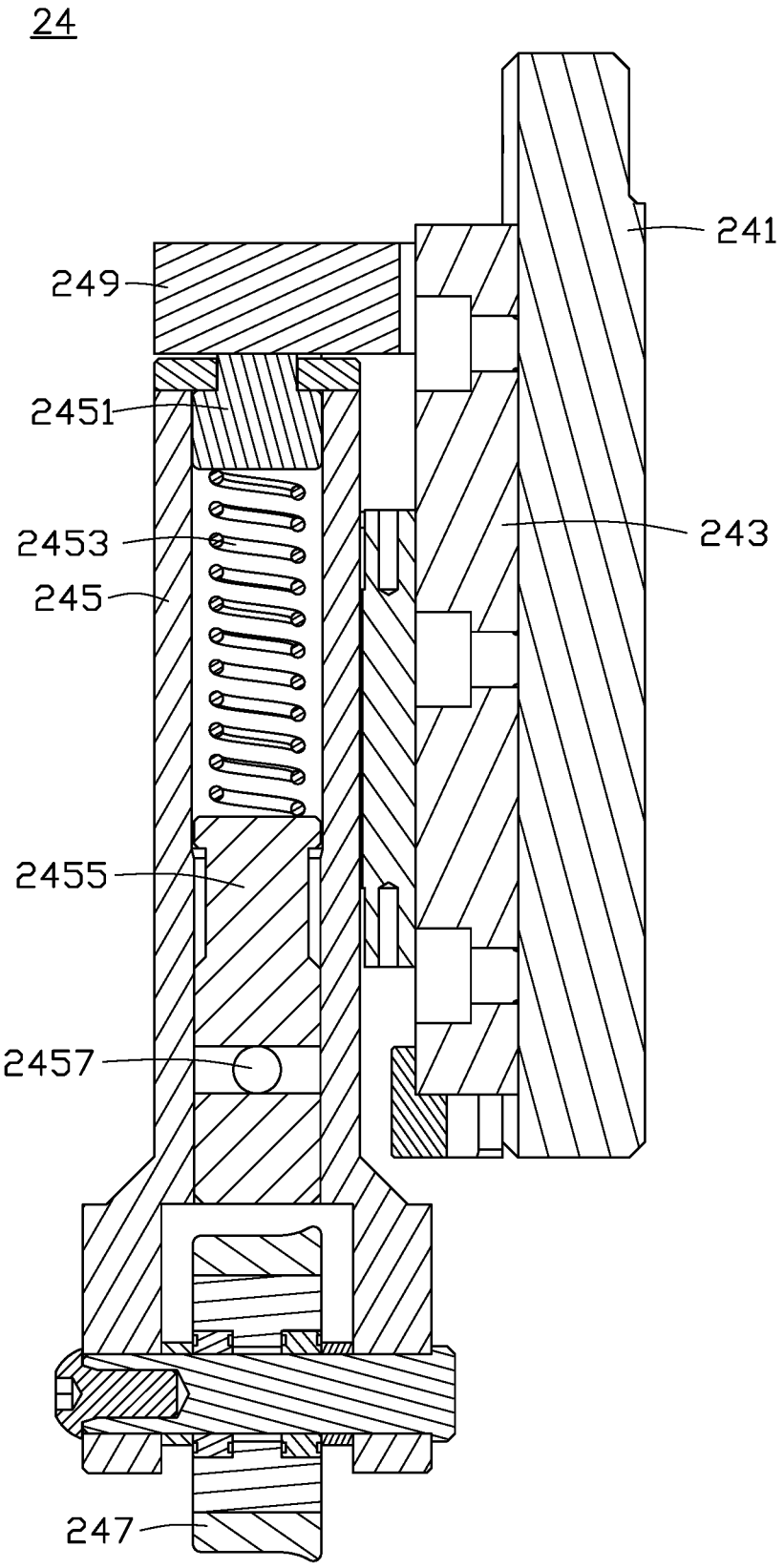
FIG. 4 is a cross-sectional view of the pressure roller taken along line IV-IV in FIG. 3.

Referring to FIG. 4, a top of the pressure rod 245 includes a top block 2451. An interior of the pressure rod 245 includes a spring 2453 and a adjusting screw 2455. The spring 2453 is located between the top block 2451 and the adjusting screw 2455. The adjusting screw 2455 adjusts pressure of the spring 2453 to control a rolling pressure of the roller wheel 247. In detail, the stopping block 249 on top of the pressure rod 245 causes the pressure rod 245 to be located at the upper limit, which is a locking position of the roller module 20. The roller wheel 247 pressure contacts the work-piece A. A pressure of the pressure wheel 247 is adjusted by adjusting a pressure of the spring 2453 by the adjusting screw 2455. In at least one embodiment, the adjusting screw 2455 includes a hole 2457 to allow a user to manually rotate the adjusting screw 2455 to adjust the pressure of the spring 2453. Because the upper limit of the pressure rod 245 is limited by the stopping block 249, by adjusting the pressure of the spring 2453, the rolling pressure of the roller wheel 247 is adjusted. In at least one embodiment, the roller wheel 247 is made of thermoplastic polyurethane. A pressure adjustment range of the pressure roller 24 is from about 2.5 kilograms to about 6 kilograms to generate about 3.2±0.5 kilogram-force (kgf).

The roller assembly 100 uses the locking assembly 30 to fix the rolling position of the roller module 20 to maintain pressing contact of the pressure roller 24 on the work-piece A, thereby achieving high rolling efficiency.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A roller assembly comprising:

a workbench;

a roller module located above the workbench; and a locking assembly coupled to the roller module and configured to position the roller module above the workbench;

wherein the roller module comprises a driving device and a pressure roller;

wherein the driving device is coupled to the pressure roller through a crank assembly; and wherein the crank assembly drives the pressure roller to move along a track to roll on a work-piece positioned on the workbench;

wherein the locking assembly is movably mounted on the workbench, the locking assembly is provided with a linking assembly comprising a fixing bar and a handle, the fixing bar is coupled to the roller module, the handle is configured to drive the fixing bar to move the roller module and lock a position of the roller module.

2. The roller assembly of claim 1, wherein the workbench comprises a platform and a pair of support frames; the platform holds the work-piece in place; the pair of support frames is erected on opposite sides of the platform; a top of each of the support frames comprises a sliding board; the locking assembly is located on the sliding boards to allow the sliding boards to move and adjust a position of the roller module above the workbench.

3. The roller assembly of claim 2, wherein the sliding board defines a sliding groove; the sliding groove receives a sliding seat of the locking assembly; the linking assembly is mounted on the sliding seat.

4. The roller assembly of claim 1, wherein the roller module comprises a first guide board and a second guide board; the first guide board and the second guide board are spaced apart and face each other; the first guide board is located above the second guide board; the driving device is located on the first guide board; the crank assembly is located between the first guide board and the second guide board; the crank assembly is coupled to the pressure roller; the pressure roller faces the work-piece; an upper surface of the second guide board defines the track.

5. The roller assembly of claim 4, wherein the driving device is a rotary handle located on an upper surface of the first guide board and pivotably coupled to the crank assembly; the crank assembly is rotationally driven by the driving device.

6. The roller assembly of claim 4, wherein the crank assembly comprises a first crank and a second crank; one end of the first crank is coupled to the driving device; a second end of the first crank is slidably coupled to a first end of the second crank; a joint between the second end of the first crank slidably coupled to the first end of the second crank is adjacent to the track defined in the upper surface of the second guide board; a second end of the second crank is coupled to the pressure roller.

7. The roller assembly of claim 6, wherein the joint between the first crank and the second crank comprises two bearings facing the second guide board; the two bearings are received within the track of the second guide board; the two bearings are movable within the track; the track controls a rolling path of the pressure roller coupled to the second crank.

8. The roller assembly of claim 6, wherein the track follows a path around the upper surface of the second guide board; the second guide board defines a space surrounded by the track; the space is hollow and open toward the workbench; the pressure roller coupled to the second crank is received within the space; the pressure roller is limited to move within the space.

9. The roller assembly of claim 7, wherein the pressure roller comprises a mounting seat, a clamping block, a pressure bar, and a roller wheel; the mounting seat is coupled to the second crank; the clamping block is located on the mounting seat; the clamping block clamps the pressure bar; a stopping block is located at a top of the pressure bar to limit an upper movement of the pressure bar; the roller wheel is located at a bottom of the pressure bar; the stopping block limiting upper movement of the pressure bar causes the pressure bar to apply pressure toward the workbench.

10. The roller assembly of claim 9, wherein a top of the pressure bar comprises a top block; an interior of the pressure block comprises a spring and an adjusting screw; the spring is located between the top block and the adjusting screw; the adjusting screw adjusts pressure of the spring to control a rolling pressure of the roller wheel.

* * * * *